US009238946B2

(12) United States Patent
Mageren

(10) Patent No.: US 9,238,946 B2
(45) Date of Patent: Jan. 19, 2016

(54) IMPROVEMENTS RELATING TO CORE BARREL OUTER TUBES

(71) Applicant: Olivier Jean-Marc Claude Mageren, Brussels (BE)

(72) Inventor: Olivier Jean-Marc Claude Mageren, Brussels (BE)

(73) Assignee: Halliburton Energy Services, Inc., Houston, TX (US)

( * ) Notice: Subject to any disclaimer, the term of this patent is extended or adjusted under 35 U.S.C. 154(b) by 309 days.

(21) Appl. No.: 13/795,507

(22) Filed: Mar. 12, 2013

(65) Prior Publication Data

US 2013/0327518 A1 Dec. 12, 2013

(30) Foreign Application Priority Data

Jun. 11, 2012 (GB) ..... 1210197.8

(51) Int. Cl.
*E21B 17/042* (2006.01)
*E21B 25/00* (2006.01)

(52) U.S. Cl.
CPC ..... *E21B 17/042* (2013.01); *E21B 25/00* (2013.01)

(58) Field of Classification Search
CPC ..... E21B 17/02; E21B 17/04; E21B 17/042; E21B 17/0426
See application file for complete search history.

(56) References Cited

U.S. PATENT DOCUMENTS

| | | | | |
|---|---|---|---|---|
| 1,961,763 | A * | 6/1934 | Hinderliter | 277/328 |
| 1,993,269 | A * | 3/1935 | Fletcher | 285/148.19 |
| 2,347,726 | A * | 5/1944 | Auld et al. | 175/233 |
| 2,551,995 | A * | 5/1951 | Brown | 175/255 |
| 3,180,438 | A * | 4/1965 | Dickinson et al. | 175/239 |
| 3,268,275 | A * | 8/1966 | Laghlin | 175/325.2 |
| 5,383,692 | A * | 1/1995 | Watts | 285/239 |
| 6,095,259 | A | 8/2000 | Keyes | |
| 6,860,514 | B2 | 3/2005 | Wentworth et al. | |
| 2003/0106717 | A1 * | 6/2003 | Kinsella | 175/20 |
| 2004/0079555 | A1 * | 4/2004 | Lange | 175/320 |

FOREIGN PATENT DOCUMENTS

| | | | |
|---|---|---|---|
| EP | 1411207 | 12/2007 | E21B 49/02 |

* cited by examiner

*Primary Examiner* — Frederick L Lagman
(74) *Attorney, Agent, or Firm* — Baker Botts L.L.P.

(57) ABSTRACT

Described herein is a "cross-over" connector that can be used with core barrel outer tubes to prevent damage and destruction when they are connected to one another by automated equipment on a rig floor, for example, automated rig-floor torque wrenches. Standard core barrel outer tubes having a pin connector and a box connector are modified by adding "cross-over" sub elements to the pin and box connectors to increase their effective strength. The sub elements include portions which engage respective ones of the pin and box connections. The sub elements are designed to be the contact points for the automated equipment, so that it they are damaged, they can readily be replaced at a lower cost when compared to the scrapping and replacement of the core barrel outer tubes themselves.

16 Claims, 3 Drawing Sheets

IMPROVEMENTS RELATING TO CORE BARREL OUTER TUBES

FOREIGN PRIORITY

This application claims foreign priority to Great Britain Application No. 1210197.8 filed Jun. 11, 2012, the contents of which are hereby incorporated by reference in their entirety.

FIELD OF INVENTION

The present invention relates to improvements relating to core barrel outer tubes.

BACKGROUND TO THE INVENTION

Core barrel outer tubes have relatively thin walls at the American Petroleum Institute (API) standard connectors that are used to connect them together in the field. The API connectors comprise "pin", "male" or screw connectors and "box", "female" or socket connectors as is well-known. These API connectors are inserted into or formed in the open ends of the core barrel outer tubes. Typically, a "pin" connector is provided at one end of the core barrel outer tube and a box" connector at the other end of the core barrel outer tube. In the field, for example, on a rig floor, a pin connector is joined to a box connector to join two core barrel outer tubes together.

"Rig-tongs" have conventionally been used for making the connections between core barrel outer tubes. The pressure applied to the core barrel in the vicinity of the "pin" and "box" connectors by "rig-tongs" is not normally sufficient to cause serious damage to the core barrel outer tubes as they are being connected to one another. However, for reasons of safety, these "rig-tongs" are being replaced by automated equipment, in particular, automated rig-floor torque wrenches. When making connections using automated rig-floor torque wrenches, the core barrel outer tubes may be damaged or destroyed due to one or more of the pressure applied to the thin walls during the connection process; the small distance between automated tongs that causes the tongs to grip directly over the outer tube connection where the wall thickness is the thinnest; and excessive pressure exerted by jaws of such automated tongs to achieve the required torque for a satisfactory connection between the tubes.

A conventional way of overcoming the problems created by automated equipment is to replace the entire core barrel outer tube with a stronger, thicker core barrel outer tube. This has the disadvantage of increasing the cost of each core barrel outer tube due to the increased raw material needed to make the stronger, thicker core barrel outer tube, as each core barrel out tube has a typical length of between 8 m and 10 m (between approximately 26 ft and 32 ft).

SUMMARY OF THE INVENTION

It is therefore an object of the present invention to provide a cross-over connection that can resist the pressure applied by automated equipment, and, in particular, automated rig-tongs.

In accordance with a first aspect of the present invention, there is provided a connector for core barrel outer tubes having pin and box connectors, the connector comprising: a first portion connectable to one of a pin connector and a box portion; and a second portion connectable to the other of the pin connector and the box connector, the second portion having a second connecting portion and a second outer wall portion; the first and second outer wall portions spaced from the respective first and second connecting portions and substantially thicker than walls of the core barrel outer tubes in the vicinity of the respective pin and box connectors.

Advantageously, the connectors of the present invention have much lower material cost than that required to provide stronger core barrel outer tubes. Their use allows commonly-used core barrel outer tubes to be adapted to resist the pressure applied by automated tools when connections are being made, and, hence damage to and destruction of the core barrel outer tubes.

Additionally, the connectors of the present invention can easily be adapted for any change in automated equipment, for example, automated rig-floor torque wrenches, used for connecting core barrel tubes together.

In one embodiment, the first portion may be connectable to the pin connector and the first connecting portion may include a threaded portion for engagement with the pin connector. In this embodiment, the second portion may be connectable to the box connector and the second connecting portion may include a threaded portion for engagement with the box connector.

In an alternative embodiment, the first portion may be connectable to the box connector and the first connection portion may include a threaded portion for engagement with the box connector. In this embodiment, the second portion may be connectable to the pin connector and the second connecting portion may include a threaded portion for engagement with the pin connector.

In another embodiment, the first connecting portion of the first portion may comprise a box connector and the first portion may provide a box connector for connection to the second portion. In this embodiment, the second connecting portion of the second portion may comprise a pin connector and the second portion provides a pin connector for connection to the first portion.

Preferably, the first and second portions may each include a substantially centralised bore.

In accordance with another aspect of the present invention, there is provided a core barrel outer tube having a connector as described above, the first portion being connected to one end of the core barrel outer tube and the second portion being connected to the other end of the core barrel outer tube.

BRIEF DESCRIPTION OF THE DRAWINGS

For a better understanding of the present invention, reference will now be made, by way of example only, to the accompanying drawings in which.

DETAILED DESCRIPTION OF THE INVENTION

Figures 1A, 1B, 1C:
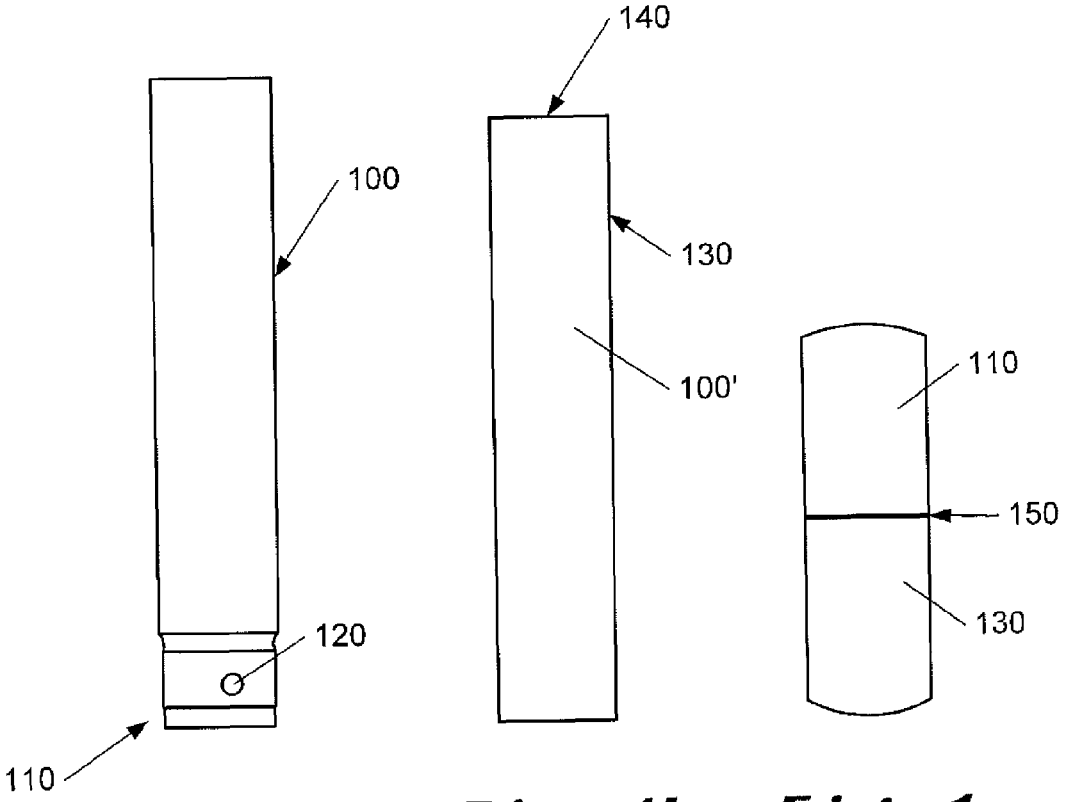
Fig. 1a Fig. 1b Fig. 1c PRIOR ART
FIG. 1*a* illustrates an end of a conventional core barrel outer tube having a pin connector.
FIG. 1*b* illustrates an end of a conventional core barrel outer tube having a box connector.
FIG. 1*c* illustrates connected ends of the core barrel outer tubes shown in FIGS. 1*a* and 1*b;*

The present invention will be described with respect to particular embodiments and with reference to certain drawings but the invention is not limited thereto. The drawings described are only schematic and are non-limiting. In the drawings, the size of some of the elements may be exaggerated and not drawn on scale for illustrative purposes.

It will be understood that the terms "vertical" and "horizontal" are used herein refer to particular orientations of the Figures and these terms are not limitations to the specific embodiments described herein. In addition, the terms "top" and "bottom" are used to distinguish one end of a core barrel outer tube from the other.

In the drilling industry, the term "top" tends to refer to the part of the drilling equipment that is nearest to the surface and the term bottom" tends to refer to the part of the drilling equipment that is furthest from the surface.

In accordance with the present invention, a "cross-over" connector is provided which comprises two sub elements which, when connected together, provide a connection for core barrel outer tubes which withstands the pressure exerted by automated equipment used for assembling such core barrel outer tubes.

It is known to use a pin with a lateral aperture to secure a core sampler to its associated drill string in core sampling apparatus as described in U.S. Pat. No. 6,095,259. Here, the core sampler is attached to the drilling string by means of a connector that is screwed to the drill string at one end and has the lateral aperture at the other end. The core sampler has a tang in which a lateral aperture is formed that, when aligned with the lateral aperture in the connector, can receive a pin to secure the core sampler to the connector.

This particular connector addresses the problem of minimising the amount of time and manpower necessary to retrieve a gathered core sample thereby minimising the impact of core sample retrieval on drilling efficiency. This is achieved by not having to break a threaded connection with the drill string to remove the core sampling apparatus. In this connector, the pin is removed from the aligned lateral apertures of the connector and tang to release the tang and allow the core sampler to be easily be extracted.

U.S. Pat. No. 6,860,514 discloses a connector for a drill string in which an adaptor is attached to a starter rod by means of a tapered threaded portion engaging a corresponding tapered threaded socket with inter-engaging profiled surfaces or spline profiles transferring the torque from the starter rod to the adaptor. The end of the adaptor remote from the starter rod includes any conventional coupling or joint that can be used to connect underground directional drilling tools.

The use of such an adaptor addresses the problem of severe torque loadings and longitudinal stresses of joints in a drill string and tool due to the mechanical stresses and abrasive conditions in which the drill string and tool operated. These conditions tend to wear threaded joints rapidly requiring frequent replacement as failure of a joint due to thread wear or joint loosening can result in a tool being stuck in a borehole or pipe.

In U.S. Pat. No. 6,860,514, the problem of torque loading and longitudinal stresses is addressed by the use of front and rear tapered pilot portions in conjunction with the tapered threaded portion and the tapered threaded socket portion. The use of these pilot portions enables the joint to be further tightened to compensate for thread wear, the threaded end portion being further tightened into the threaded socket by advancing over tapered shoulders of the pilot portions. This engagement with the tapered pilot portions provides additional being moment loading.

EP-A-1411207 describes an adaptor coupling for connecting a sail sampler barrel to a drill rod, the adaptor coupling having a barrel adaptor and a rod adaptor for connecting to respective ones of the soil sampler barrel and the drill rod. The adaptor coupling also includes an isolating mechanism which isolates the sampler barrel from any upward vibratory movement of the drill rod so that it only receives downward motion from the drill rod.

The problem addressed by this adaptor coupling is to minimise the amount of disturbance of soil samples taken with vibratory drill systems and to reduce the amount of friction between the barrel sampler and the ground. The isolating mechanism in the adaptor coupling overcomes this problem.

Whilst various types of connectors are described in U.S. Pat. No. 6,095,259, U.S. Pat. No. 6,860,514 and EP-A-1411207, none of these connectors address the problem of the present invention, that is, to prevent damage and destruction to core barrel outer tubes during their assembly on a drill rig.

Referring initially to FIG. 1*a*, a conventional core barrel outer tube 100 is shown having an end 110 having a pin connector 120. FIG. 1*b* shows a second core barrel outer tube 100' which is to be connected to the core barrel outer tube 100 shown in FIG. 1*a*. The core barrel outer tube 100' has an end 130 having a box connector 140. It will be appreciated that the core barrel outer tubes 100' may be identical and each has a pin connector at one end and a box connector at the other end (not shown). When the core barrel outer tubes 100, 100' are to be connected, the pin connector 120 of tube 100 is connected to the box connector 140 of tube 100' to form a joint 150 as shown in FIG. 1*c*.

In accordance with the present invention, a "cross-over" sub connector is provided. The "cross-over" sub connector comprises sub elements which are attached to core barrel outer tubes so that the core barrel outer tubes can resist the pressure applied to them by automated rig-floor torque wrenches when they are being assembled. The "cross-over" sub elements are effectively paired so that a "top" sub element of one core barrel outer tube is connected to a "bottom" sub element of another core barrel outer tube. By using these "cross-over" sub elements, the core barrel outer tubes remain unaltered and the connections between the "cross-over" sub elements and the tube itself can be made under controlled conditions in a warehouse or other suitable location before sending the core barrel equipment to the rig. On the rig, two core barrel outer tubes are connected to one another so that the sub elements are effectively paired, that is, a "top" sub element is connected to a "bottom" sub element, using automated rig-floor torque wrenches.

Figure 2A:
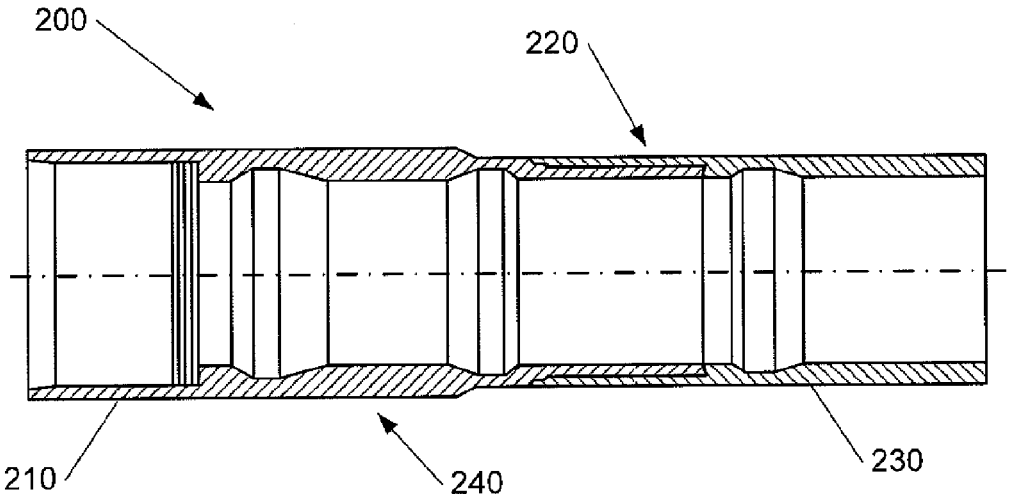
FIG. 2*a* illustrates an end of a core barrel outer tube having a top "cross-over" sub element in accordance with the present invention.

FIG. 2*a* illustrates a "top" sub element assembly 200 in which a "top" sub element 210 is inserted into an end 220 of a core barrel outer tube 230. As shown, the "top" sub element 210 has a region 240 that has a thicker wall than the wall of the core barrel outer tube 230. It is with this region 240 that the automated rig-floor torque wrench (not shown) engages to make the connection between two core barrel outer tubes.

It will be appreciated that the end 220 of the core barrel outer tube 230 may comprise a box connector into which the "top" sub element 210 is inserted. The region 240 is spaced from the portion of the "top" sub element 210 that engages with the box connector (not shown). In this way, the pressure applied to the "top" sub element in the region 240 does not damage the core barrel outer tube 230 in the vicinity of the box connector.

Figure 2B:
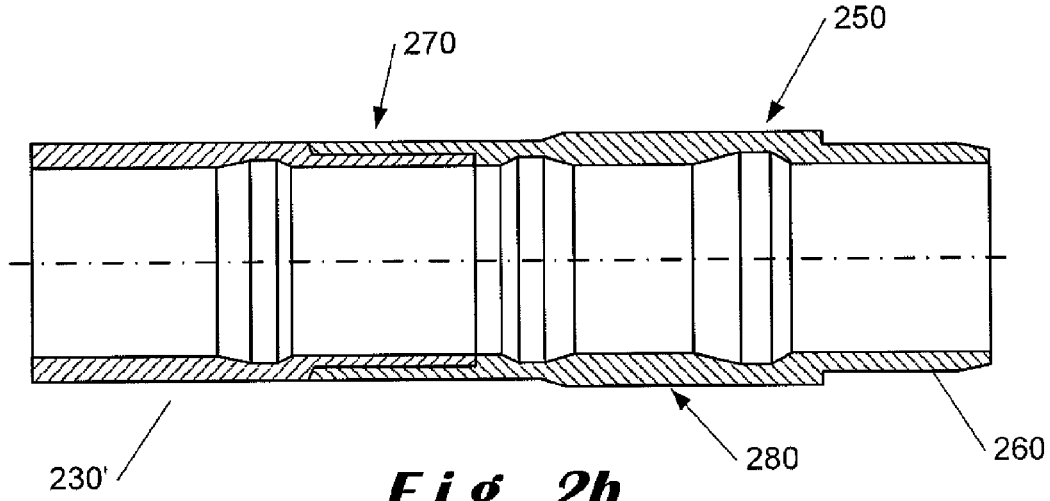
FIG. 2*b* illustrates an end of a core barrel outer tube having a bottom °cross-over" sub element in accordance with the present invention.

FIG. 2*b* illustrates a "bottom" sub element assembly 250 in which a "bottom" sub element 260 is inserted into an end 270 of a core barrel outer tube 230'. As shown, the "bottom" sub element 260 has a region 280 that has a thicker wall than the wall of the core barrel outer tube 230'. It is with this region 280 that the automated rig-floor torque wrench (not shown) engages to make the connection between two core barrel outer tubes.

It will be appreciated that the end 270 of the core barrel outer tube 230' may comprise a pin connector into which the "bottom" sub element 260 is attached. The region 280 is spaced from the portion of the "bottom" sub element 260 that engages with the pin connector (not shown). In this way, the pressure applied to the "bottom" sub element in the region 280 does not damage the core barrel outer tube 230 in the vicinity of the pin connector.

Figure 2C:
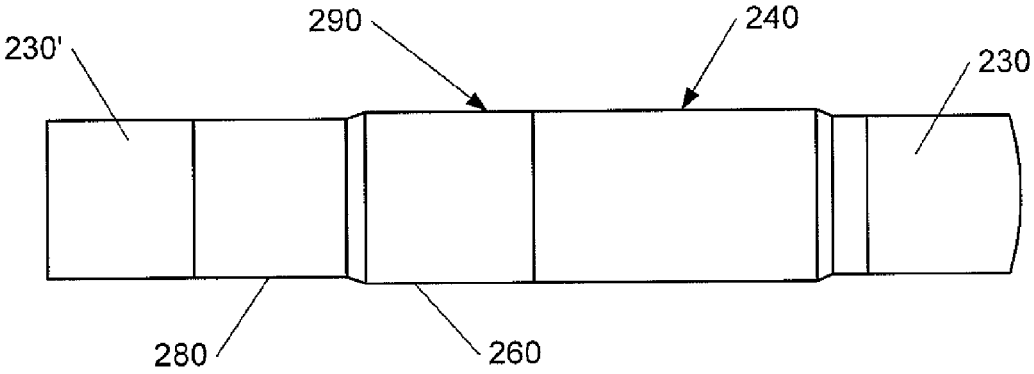
FIG. 2*c* illustrates connected ends of the core barrel outer tube shown in FIGS. 2*a* and 2*b*.

FIG. 2*c* illustrates two core barrel outer tubes 230, 230' connected together by means of respective "top" and "bottom" sub elements 210, 260 to form a joint 290.

Although the "top" sub element 210 and the "bottom" sub element 260 are described as connecting to the core barrel outer tube by means of respective box and pin connectors, it will be appreciated that the "top" sub element 210 and the "bottom" sub element 260 may connect to a pin and a box connector respectively.

In another embodiment, the core barrel outer tubes may comprise either box or pin connectors only, and in this case, the "cross over" sub elements may comprise either pin or box connectors only as appropriate.

Each of the "top" and "bottom" sub elements of the connector of the present invention may comprise a "pin-to-pin" sub element where one pin engages a box connector of the core barrel outer tube and the other pin engages a box connector of the other sub element.

Similarly, each of the "top" and "bottom" sub elements of the connector of the present invention may comprise a "box-to-box" sub element where on box engages a pin connector of the core barrel outer tube and the other box engages a pin connector of the other sub element.

However, it may be preferred that each of the "top" and "bottom" sub elements comprise conventional "pin-to-box" and/or "box-to-pin" sub elements. In the former case, the pin engages the box connector of the core barrel outer tube and the box engages the pin connector of the other sub element, and in the latter case, the box engages the pin connector of the core barrel outer tube and the pin engages the box connector of the other sub element.

Figure 3A:
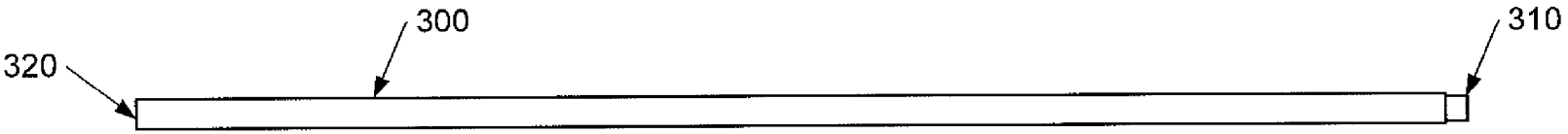
FIGS. 3*a*, 3*b* and 3*c* illustrate respective assembly stages for the top and bottom cross-over sub element in accordance with the present invention.
Figure 3B:
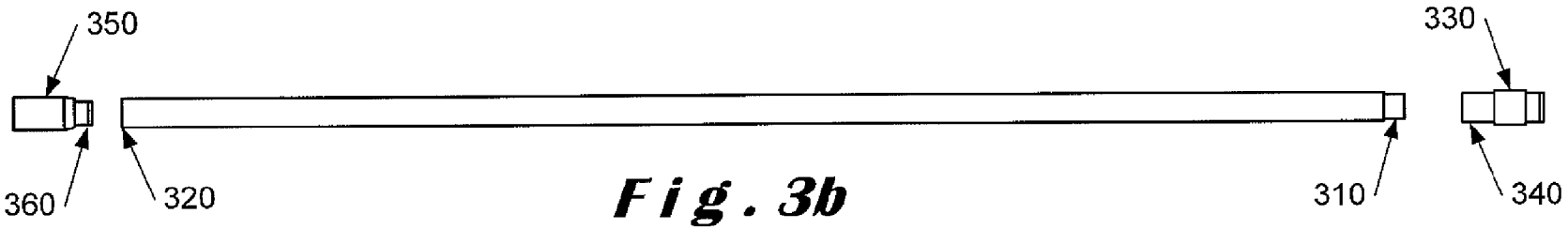
Figure 3C:
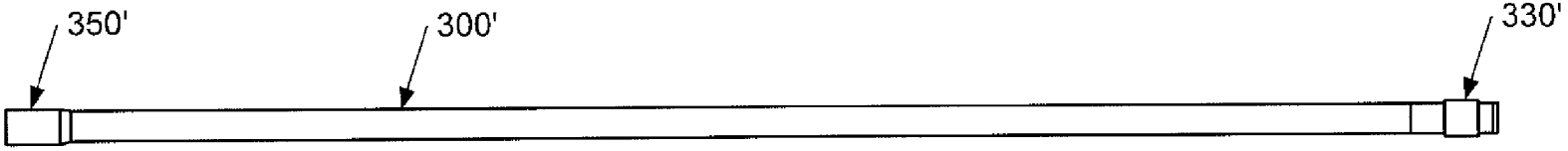

FIGS. 3*a*, 3*b* and 3*c* illustrate respective stages in the assembly of the sub elements with a core barrel outer tube in a warehouse or other suitable location.

FIG. 3*a* shows a conventional core barrel outer tube 300 having a pin connector 310 at one end and a box connector 320 at the other end.

FIG. 3*b* illustrates a "bottom" sub element 330 being added to the pin connector 310 with the "bottom" sub element 330 having a portion 340 which engages and surrounds the pin connector 310. Similarly, at the other end, a "top" sub element 350 is added to the box connector 320 with the "top" sub element 350 having a portion 360 that engages with the box connector 320 as shown.

In FIG. 3*c*, an assembled core barrel outer tube 300' with respective "top" and "bottom" sub elements 330', 350' is shown.

Once the core barrel outer tubes 300' are on the rig, they can be assembled using the stronger and thicker connections provided by the "top" and "bottom" sub elements so that the core barrel outer tube itself is not damaged.

The use of the sub elements provides stronger and thicker connections than the ones provided between pin and box connectors of core barrel outer tubes. Whilst the inner diameter of each sub element is substantially the same as the core barrel outer tube itself, their outer diameter is larger than the outer diameter of the tube thereby providing thicker walls which are stronger for engaging with automated rig-floor torque wrenches when connecting one core barrel outer tube to another.

Each core barrel outer tube is inspected after each run, and, if the sub elements do not pass inspection criteria, they can be scrapped rather than having to scrap an entire core barrel outer tube.

Each sub element pair, namely, a "top" and a 'bottom" sub element, can be configured to meet the changing needs of automated rig-floor torque wrenches. This means that it is possible to react rapidly to any change in the type of torque wrenches used on the rig floor at reduced cost as only the "cross-over" connector or sub element pair needs to be modified and not the core barrel outer tube itself.

Additionally, current stocks of core barrel outer tubes that were designed for conventional non-automated tools can be updated by the simple addition of the sub element pairs so that they can readily be used with automated tools without having to be redesigned.

The "cross-over" sub elements can be made from a different material to the core barrel outer tube due to their substantially shorter lengths, a wider range of materials and raw material stock sizes being available for the shorter lengths.

The weakest part of a conventional core barrel outer tube is its threaded connections as the cross-section through the tube at these points is reduced. Frequent connections and disconnections increase the wear of the tube and therefore decrease its useful life. The use of the "cross-over" sub connections increases the useful life of each core barrel outer tube with which they are used. Each core barrel outer tube can effectively be refurbished when the "cross-over" sub element forming the "cross-over" sub connection can be replaced without damaging the core barrel outer tube itself.

Although the present invention is described in relation to core barrel outer tubes, it will be appreciated that the "cross-over" connectors as described above can be used in any situation where pressure is applied to a relatively weak portion of a drill string during its assembly.

What is claimed is:

1. A connector for core barrel outer tubes having pin and box connectors, comprising:

a first portion connectable to a pin connector of a first core barrel outer tube, the first portion having a first connecting portion and a first outer wall portion; and a second portion connectable to a box connector of a second core barrel outer tube, the second portion having a second connecting portion and a second outer wall portion;

the first and second outer wall portions spaced from the respective first and second connecting portions and having an inner diameter approximately equal to an inner diameter of the first and second core barrel outer tubes and an outer diameter greater than an outer diameter of the first and second core barrel outer tubes.

2. A connector according to claim 1, wherein the first portion is connectable to the pin connector and the first connecting portion includes a threaded portion for engagement with the pin connector.

3. A connector according to claim 2, wherein the second portion is connectable to the box connector and the second connecting portion includes a threaded portion for engagement with the box connector.

4. A connector according to claim 1, wherein the first portion is connectable to the box connector and the first connection portion includes a threaded portion for engagement with the box connector.

5. A connector according to claim 4, wherein the second portion is connectable to the pin connector and the second connecting portion includes a threaded portion for engagement with the pin connector.

6. A connector according to claim 1, wherein the first connecting portion of the first portion comprises a box connector and the first portion provides a box connector for connection to the second portion.

7. A connector according to claim 6, wherein the second connecting portion of the second portion comprises a pin connector and the second portion provides a pin connector for connection to the first portion.

8. A connector according to claim 1, wherein the first and second portions each include a substantially centralised bore.

9. A core barrel outer tube, comprising:

a first end and a second end;

a first sub-element coupled to the first end, the second sub-element including a first portion connectable to a pin connector, the first portion having a first connecting portion and a first outer wall portion; and a second sub-element coupled to the second end, the second sub-element including a second portion connectable to a box connector, the second portion having a second connecting portion and a second outer wall portion;

the first and second outer wall portions spaced from the respective first and second connecting portions and having an inner diameter approximately equal to an inner diameter of the outer tube and an outer diameter greater than an outer diameter of the outer tube.

10. A core barrel outer tube according to claim 9, wherein the first portion is connectable to the pin connector and the first connecting portion includes a threaded portion for engagement with the pin connector.

11. A core barrel outer tube according to claim 10, wherein the second portion is connectable to the box connector and the second connecting portion includes a threaded portion for engagement with the box connector.

12. A core barrel outer tube according to claim 9, wherein the first portion is connectable to the box connector and the first connection portion includes a threaded portion for engagement with the box connector.

13. A core barrel outer tube according to claim 12, wherein the second portion is connectable to the pin connector and the second connecting portion includes a threaded portion for engagement with the pin connector.

14. A core barrel outer tube according to claim 9, wherein the first connecting portion of the first portion comprises a box connector and the first portion provides a box connector for connection to the second portion.

15. A core barrel outer tube according to claim 14, wherein the second connecting portion of the second portion comprises a pin connector and the second portion provides a pin connector for connection to the first portion.

16. A core barrel outer tube according to claim 9, wherein the first and second portions each include a substantially centralised bore.

* * * * *